US009421796B2

(12) United States Patent
Shiokawa

(10) Patent No.: US 9,421,796 B2
(45) Date of Patent: Aug. 23, 2016

(54) SHEET PROCESSING APPARATUS AND IMAGE FORMING SYSTEM

(71) Applicant: Konica Minolta, Inc., Tokyo (JP)

(72) Inventor: Tsuyoshi Shiokawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/947,477

(22) Filed: Nov. 20, 2015

(65) Prior Publication Data

US 2016/0152050 A1 Jun. 2, 2016

(30) Foreign Application Priority Data

Nov. 28, 2014 (JP) ..... 2014-240923

(51) Int. Cl.
*B41J 11/66* (2006.01)
*B26D 5/08* (2006.01)
*B26D 7/27* (2006.01)

(52) U.S. Cl.
CPC ..... *B41J 11/663* (2013.01); *B26D 5/08* (2013.01); *B26D 7/27* (2013.01)

(58) Field of Classification Search
CPC ..... B41J 11/663; B26D 5/08; B26D 7/27
See application file for complete search history.

(56) References Cited

U.S. PATENT DOCUMENTS

2005/0073082 A1* 4/2005 Wakabayashi ..... B41L 43/00 270/37
2005/0147487 A1* 7/2005 Wakabayashi ..... B26D 1/20 412/9
2008/0112018 A1* 5/2008 Sato ..... B26D 7/18 358/468

FOREIGN PATENT DOCUMENTS

JP 2014043328 A 3/2014

* cited by examiner

*Primary Examiner* — Stephen Meier
*Assistant Examiner* — Alexander D Shenderov
(74) *Attorney, Agent, or Firm* — Cantor Colburn LLP

(57) ABSTRACT

A sheet processing apparatus includes a trimming section, a container, a detector and a control section. The trimming section performs trimming to trim a sheet or sheet set. The container collects a chip produced by the trimming in the trimming section. The detector detects a presence of the chip at a predetermined height. The control section makes the trimming section perform the trimming of a next sheet or sheet set when the detector detects the chip. Then, the control section determines that a top of piled chips in the container has reached the predetermined height when the detector still detects the presence of the chip after the trimming of the next sheet or sheet set.

8 Claims, 10 Drawing Sheets

SHEET PROCESSING APPARATUS AND IMAGE FORMING SYSTEM

CROSS REFERENCE TO RELATED APPLICATIONS

The present invention claims priority under 35 U.S.C. §119 to Japanese Application No. 2014-240923 filed Nov. 28, 2014, the entire content of which is incorporated herein by reference.

BACKGROUND OF THE INVENTION

1. Field of the Invention

The present invention relates to a sheet processing apparatus and an image forming system.

2. Description of Related Art

Sheet processing apparatuses that perform trimming to cut off a part of a sheet, such as fore edge trimming to trim the fore edge of a saddle-stitched booklet, have been known in the art.

Typically, an apparatus for trimming includes a container to collect chips produced in the trimming process and is configured such that a detector detects whether the top of chips piled up in a mountain shape in the container has reached a predetermined height. For example, when the detector detects that the top of the piled chips has reached the full level of the container, it is notified to a user so that he/she can take out the container from the apparatus to dispose the chips.

In such apparatuses, it is desirable that chips are collected in a container with leaving as little space as possible in order to reduce a burden on the user of disposing the chips. For this reason, a proposal has been made in which a container moves back and forth so as to flatten the piled chips in the container (e.g. see JP 2014-043328A).

However, a problem with the technique of JP 2014-043328A is that when a chip sticks to a detecting area of the detector, for example, due to reasons that the chip is electrostatically charged or a part of the chip gets stuck inside the apparatus, the detector erroneously detects it even though the top of the piled chips has not reached the predetermined height yet.

SUMMARY OF THE INVENTION

The present invention was made in view of the above-described problem with the prior art, and an object thereof is to provide a sheet processing apparatus and an image forming system that can correctly detect that the top of piled chips has reached a predetermined height while they perform processing that produces a chip.

In order to realize the above object, according to a first aspect of the present invention, there is provided a sheet processing apparatus, including:

a trimming section which performs trimming to trim a sheet or sheet set;

a container which collects a chip produced by the trimming in the trimming section;

a detector which detects a presence of the chip at a predetermined height; and a control section which controls the trimming section, wherein the control section makes the trimming section perform the trimming of a next sheet or sheet set when the detector detects the chip and then determines that a top of piled chips in the container has reached the predetermined height when the detector still detects the presence of the chip after the trimming of the next sheet or sheet set.

Preferably, the sheet processing apparatus further includes a movable part which is disposed above the detector and which comes in contact with the chip produced by the trimming in the trimming section to apply a force in at least one of horizontal and downward directions.

Preferably, in the sheet processing apparatus, the movable part comprises a movable member that extends in a width direction of the sheet.

Preferably, in the sheet processing apparatus, the movable member comprises a rotating shaft which extends in the width direction of the sheet and fins which are disposed on the rotating shaft.

Preferably, in the sheet processing apparatus, the control section makes the trimming section perform the trimming of a next plurality of sheets or sheet sets when the detector detects the chip and which then determines that the top of the piled chips in the container has reached the predetermined height when the detector still detects the presence of the chip after the trimming of the next plurality of sheets or sheet sets.

Preferably, the sheet processing apparatus further includes an estimating section which estimates the amount of free space of the container, wherein the control section selects the number of times of the trimming that the trimming section performs to the next plurality of sheets or sheet sets according to the amount of free space of the container estimated by the estimating section.

Preferably, in the sheet processing apparatus, the control section makes the trimming section perform the trimming of the next sheet or sheet set when the detector detects the chip and which then determines that the top of the piled chips in the container has reached the predetermined height when the detector still detects the presence of the chip after a predetermined time has elapsed since the trimming of the next sheet or sheet set.

According to a second aspect of the present invention, there is provided an image forming system, including:

an image forming apparatus which forms an image on a sheet or sheet set; and the sheet processing apparatus which is connected with the image forming apparatus and which performs trimming of the sheet or sheet set on which the image is formed by the image forming apparatus.

BRIEF DESCRIPTION OF THE DRAWINGS

The above and other objects, advantages and features of the present invention will become more fully understood from the detailed description given herein below and the appended drawings which are given by way of illustration only, and thus are not intended as a definition of the limits of the present invention, and wherein.

DETAILED DESCRIPTION OF PREFERRED EMBODIMENT

First Embodiment

Figure 1:
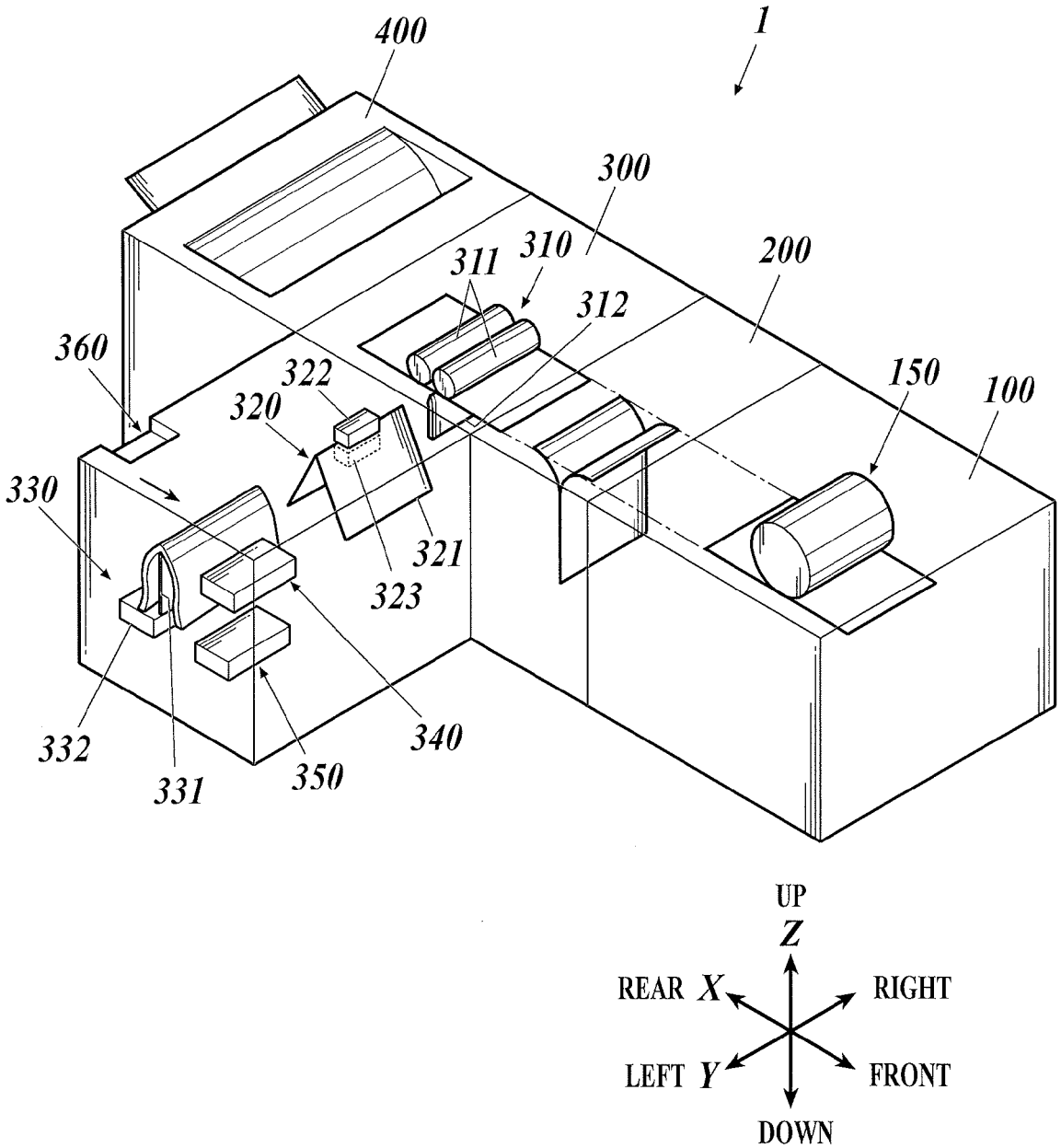
FIG. 1 is a schematic view illustrating the entire configuration of an image forming system.

Hereinafter, an image forming system 1 according to a first embodiment of the present invention will be described referring to the drawings.

FIG. 1 is a schematic view illustrating the entire configuration of the image forming system 1.

The image forming system 1 includes an image forming apparatus 100, an intermediate conveyance apparatus 200, a sheet processing apparatus 300 and a side stitching apparatus 400.

In the following description, the vertical direction is referred to as Z direction. The direction in which the image forming apparatus 100, the intermediate conveyance apparatus 200, the sheet processing apparatus 300 and the side stitching apparatus 400 in FIG. 1 are connected with each other is referred to as X direction. The direction orthogonal to both the X and Z directions is referred to as Y direction.

The X direction has front and rear sides, the Y direction has right and left sides, and the Z direction has up and down sides. The front side is upstream and the rear side is downstream when a sheet is conveyed in the image forming system 1. The right side is upstream and the left side is downstream when a sheet is conveyed in half folding and saddle stitching processing by the saddle stitching apparatus 300.

The image forming apparatus 100 forms an image on a sheet of paper.

In specific, the image forming apparatus 100 for forming an image on a sheet includes, for example, a conveyance section to extract and convey a sheet from the sheets stored as recording media from a sheet tray, a developing section to develop a toner image based on bitmap data onto a first transfer member such as transfer roller, a first transfer section to transfer the toner image developed on the first transfer member onto a second transfer member such as a transfer drum 150, a second transfer section to transfer the toner image on the second transfer member onto the sheet conveyed by the conveyance section, a fixing section to fix the transferred toner image onto the sheet, and an ejecting section to eject the sheet after the fixation by the fixing section.

The image forming apparatus 100 passes the ejected sheet which has the image formed thereon to the intermediate conveyance apparatus 200. That is, the connection in the image forming system 1 allows the sheet ejected from the image forming apparatus 100 to be passed to the intermediate conveyance apparatus 200.

The intermediate conveyance apparatus 200 can temporarily stack a sheet and score and trim the sheet.

Specifically, the intermediate conveyance apparatus 200 includes, for example, a standby section (stacker) which conveys downward a sheet conveyed from the image forming apparatus 100 and makes the sheet stop once to standby with the sheet surface along the Z direction; an alignment section which aligns the position of the sheet during standby; a scoring section (creaser) which scores the aligned sheet; and a margin trimming section (slitter) which trims off margins in the sheet while the conveyance of the scored sheet.

That is, the intermediate conveyance apparatus 200 once stops the sheet passed from the image forming apparatus 100 at the standby section, aligns the sheet with the alignment section, scores the sheet with the scoring section, and thereafter trims the margins in the sheet with the margin trimming section while conveying the scored sheet. Then, the intermediate conveyance apparatus 200 passes the sheet with the margins trimmed off by the margin trimming section to the sheet processing apparatus 300.

The intermediate conveyance apparatus 200 can also pass the sheet received from the image forming apparatus 100 to the sheet processing apparatus 300 without performing a part or all of the various processes by the intermediate conveyance apparatus 200.

The sheet processing apparatus 300 performs half folding that is folding the sheet in half (in two), saddle stitching that is stapling a predetermined number of stacked half-folded sheets to create a saddle-stitched booklet, trimming that is trimming a fore edge of the booklet, square back forming that is forming a square back, and such like.

In specific, the sheet processing apparatus 300 includes, for example:

a half folding section 310 which folds the sheet received from the intermediate conveyance apparatus 200 in half along the Y direction;

a saddle stitching section 320 which overlays the folded sheets and which inserts staples into the sheet bundle to form a saddle-stitched booklet;

a sheet conveying section 330 which receives the saddle-stitched booklet and which conveys the booklet in the direction perpendicular to the crease (X direction) along a horizontal plane;

a clamping section 340 which clamps a part around the crease of the saddle-stitched booklet conveyed by the sheet conveying section 330;

an edge trimming section 350 which trims a fore edge of the saddle-stitched booklet held by the clamping section 340; and an ejecting section 360 which ejects the saddle-stitched booklet outward.

This sheet processing apparatus 300 can also pass the sheet received from the intermediate conveyance apparatus 200 to the side stitching apparatus 400 without performing a part or all of the various processes by the sheet processing apparatus 300. In addition to the above-described components, for example, the sheet processing apparatus 300 may further include a square back forming section that forms the spine of a saddle-stitched booklet into a square shape, and the like.

The half folding section 310 includes, for example, a pair of half folding rollers 311, 311 and a plate-like folding knife 312 which is located along the Y-Z plane below the pair of half folding rollers 311, 311 and which is movable so as to come between the half folding rollers 311, 311.

A sheet received from the image forming apparatus is conveyed until the center of the sheet in the X direction faces the folding knife 312. Then the folding knife 312 comes between the half folding rollers 311, 311, and thereby pushes the sheet into the nip unit. Thus, the sheet is folded in two so as to have a crease along the Y direction at the position contacting the folding knife 312. That is, the sheet is in what is called a mountain fold shape with the crease up and the both edges down (mountain-shaped sheet).

The half-folded sheet is conveyed in the direction (Y direction) along the crease to the saddle stitching section 320 by a conveyance section, which is not shown in drawings.

The saddle stitching section 330 includes a saddle unit 321 to overlay and accumulate sheets conveyed from the half folding section 310, a staple inserting section 322 provided above the saddle unit 321, a staple receiving section 323 provided inside the saddle unit 321, etc.

After a predetermined number of sheets are stacked on the saddle unit 321, the staple inserting section 322 and the staple receiving section 323 cooperate to insert a staple into the crease of the sheets so that a saddle-stitched booklet is formed. The formed saddle-stitched booklet is pushed out to the sheet conveying section 330 downstream by an alignment section (not shown in drawings) provided at the right end (the upstream end in the conveyance direction) of the saddle unit 321.

The sheet conveying section 330 includes a plate-like buffer saddle 331 placed along the Y-Z plane and a movable unit 332 which is movable both ways in the X direction.

After the saddle-stitched booklet is pushed out of the saddle stitching section 320, the buffer saddle 331 supports the crease (stitch portion) of the booklet from below. After the buffer saddle 331 supports the saddle-stitched booklet, the movable unit 332 moves to the front side from the rear side in the X direction to pass the booklet to the clamping section 340.

Figure 2:
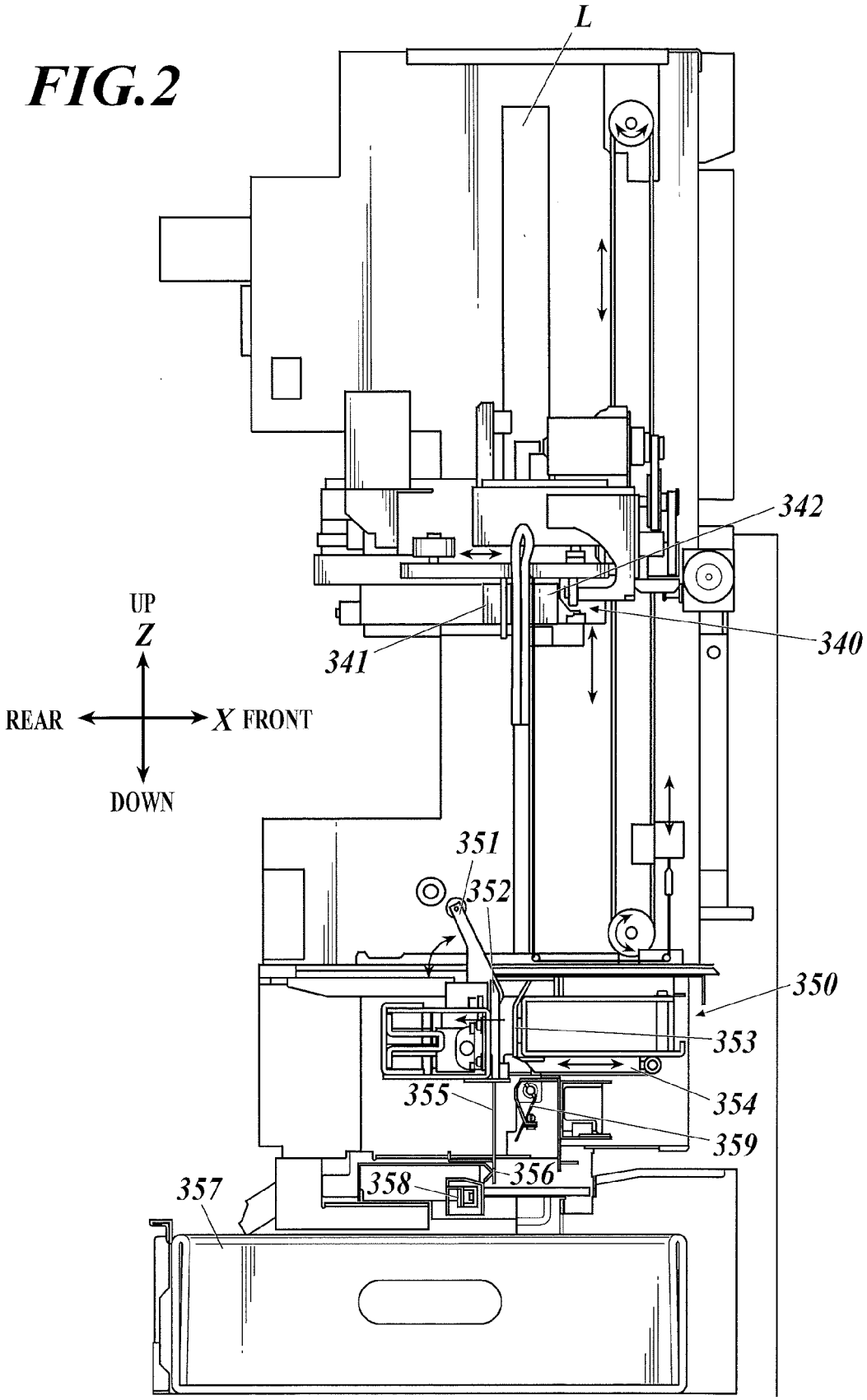
FIG. 2 illustrates an example of a configuration including a clamping section and a trimming section.
Figure 3:
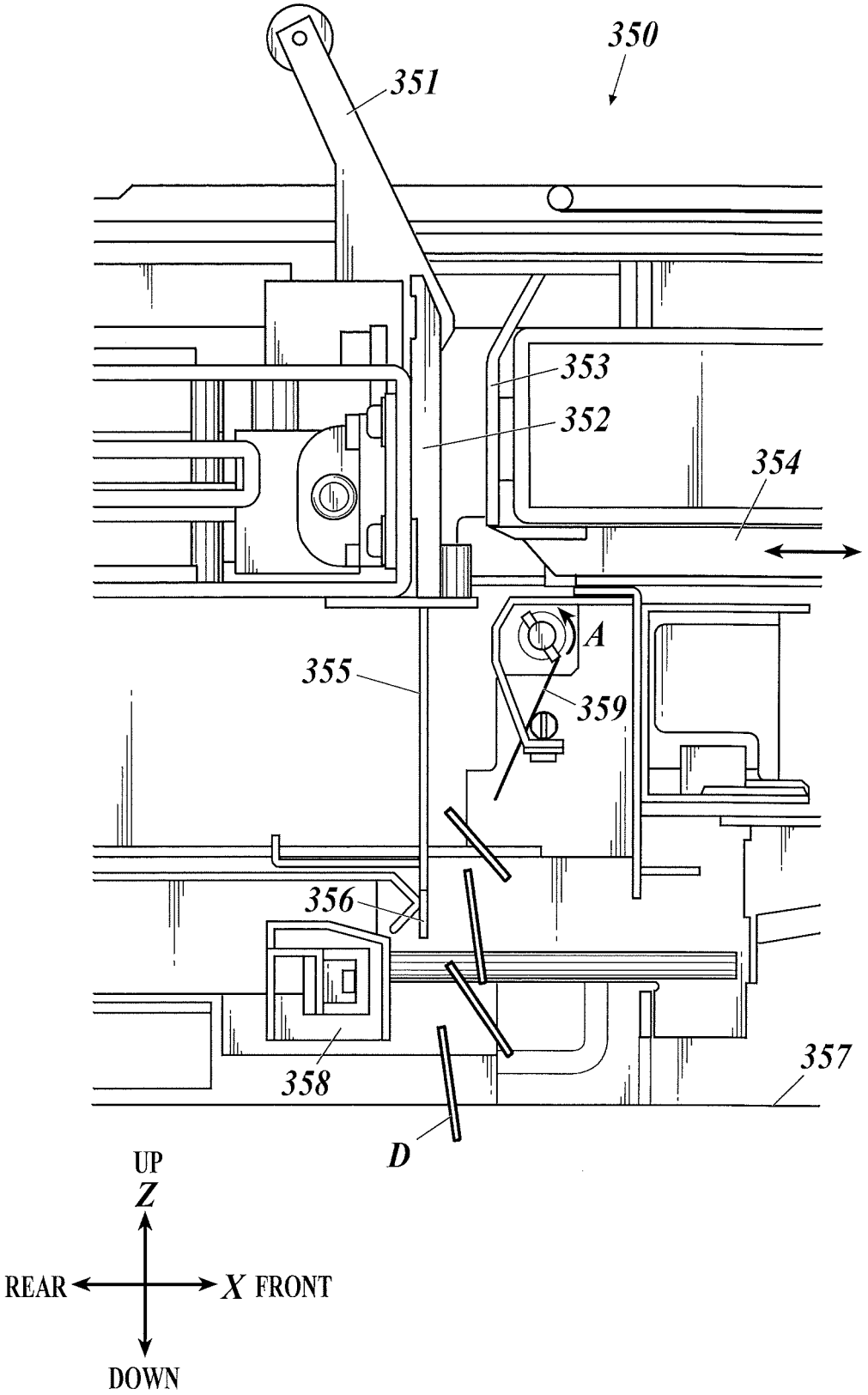
FIG. 3 illustrates an example of the configuration of a trimming section.

FIG. 2 illustrates an example of the configuration of a clamping section 340 and a fore edge trimming section 350 of the sheet processing apparatus 300. FIG. 3 illustrates an example of the configuration of the fore edge trimming section 350.

As shown in FIG. 2, the clamping section 340 is Placed above the edge trimming section 350 and can move up and down along a guide rail L placed along the Z direction.

The clamping section 340 includes a pair of clamp members 341, 342. The clamping section 340 clamps the saddle-stitched booklet near the crease with the clamp members 341, 342 after the sheet conveyance mechanism 330 conveys the booklet from the rear to the front, so as to hold the booklet.

As the clamping section 340 goes down clamping the saddle-stitched booklet, the fore edge side of the saddle-stitched booklet enters the edge trimming section 350.

The fore edge trimming section 350, which is Located below the clamping section 340, performs trimming to cut off the fore edge of the saddle-stitched booklet that comes down while the clamping section 340 holds it.

As illustrated in FIG. 3, the fore edge trimming section 350 includes, for example, an approach guiding section 351, a trim and clamp members 352, 353, a trimming knife 354, an electrically conductive sheet 355, an antistatic brush 356, a container 357, a detector 358, a movable part 359 and the like.

The trim and clamp members 352, 353 and the trimming knife 354 constitute a trimming section.

The approach guiding section 351 is to guide the fore edge of the saddle-stitched booklet approaching from above. The approach guiding section 351 has, for example, an inclined face that extends upward from the location of the trim and clamp member 352, which is located to the rear side among the trim and clamp members 352, 353, and that spreads in a fan shape toward the rear side in the X direction. The inclined face continues to the gap between the trim and clamp members 352, 353 so as to guide the approaching saddle-stitched booklet.

After the saddle-stitched booklet enters the gap between the trim and clamp members 352, 353, the approach guiding section 351 may be retracted, for example, by swinging backward as illustrated in FIG. 2 or the like.

The trimming clamping sections 352, 353 are disposed separately from each other with a gap having a predetermined width in the X direction so that the saddle-stitched booklet can enter therebetween.

Among the trim and clamp members 352, 353, the rear trim and clamp member 352 is disposed movably in the X direction. After the fore edge of the saddle-stitched booklet enters the gap between the trim and clamp members 352, 353 to reach a predetermined position, the rear trim and clamp member 352 moves in the direction toward the front trim and clamp member 353 so as to clamp the saddle-stitched booklet near the fore edge in cooperation with the rear trim and clamp member 353.

The trimming knife 354, which is long in the Y direction and has a blade at the rear side, is disposed movably in the X direction. While the trim and clamp members 352, 353 are clamping the saddle-stitched booklet near the fore edge, the trimming knife 354 moves to trim the fore edge of the saddle-stitched booklet. As a result, the uneven fore edge of the saddle-stitched booklet is cut horizontally into a flat shape. Further, produced chips D fall in the downward direction.

The electrically conductive sheet 355 is a plate member that is disposed parallel to the Y-Z plane. The electrically conductive sheet 355 is disposed such that it extends downward from the location of the trim and clamp member 352, which is located to the rear side among the trim and clamp members 352, 353, so as to form a falling pathway of the chips D.

The electrically conducive sheet 355 is made of a material that can prevent the chips D from sticking. By forming the falling pathway of the chips D with the electrically conductive sheet 355, the chips D are less likely to electrostatically stick to the falling pathway.

The antistatic brush 356 is disposed at the lower end of the electrically conductive sheet 355.

The chips D falling down from above come in contact with the antistatic brush 356, and the electrostatic charge is thereby eliminated.

The container 357 is a box that is open upwardly for collecting the chips D falling down from above.

The container 357 is drawable to the fore side, and the user draws it to the fore side to dispose the chips D.

The detector 358, which is disposed below the trim and clamp members 352, 353 and the trimming knife 354 and above the container 357, detects a chip D that is present in the detecting area of the detector 358 (at a predetermined height).

The detector 358 may be constituted by, for example, a reflective optical sensor having a light emitting unit and a light receiving unit. That is, when a chip D is present at a height approximately opposed to the detector 358, light emitted from the light emitting unit is reflected on the chip D. The light receiving unit receives the reflected light, and a detection signal is output to the sheet processing control section 505 (described below).

This optical sensor is merely an example, and the configuration of the detector 358 is not limited thereto. For example, a detector described in JP 2011-136375A, which detects the loading state of chips by means of electromagnetic wave, may also be used.

The predetermined height to be detected by the detector 358 depends on the location of the detector 358. Accordingly, the amount of chips D in the container 357 when the detector 358 becomes "ON" can be suitably adjusted by changing the location of the detector 358. For example, when the detector 358 is disposed near the opening of the container 357 with which the chips D falling down from the fore edge trimming section 350 are collected, the detector 358 can detect that the chips D are collected approximately to the full level of the container 357. When the detector 358 is disposed near the center in the vertical direction of the container 357, the detector 358 can detect that the chips D are collected approximately to a half level of the container 357.

The movable part 359 starts to move when the fore edge trimming of a saddle-stitched booklet starts and then comes in contact with the produced chips D to help the chips D fall in the downward direction.

Figure 4:
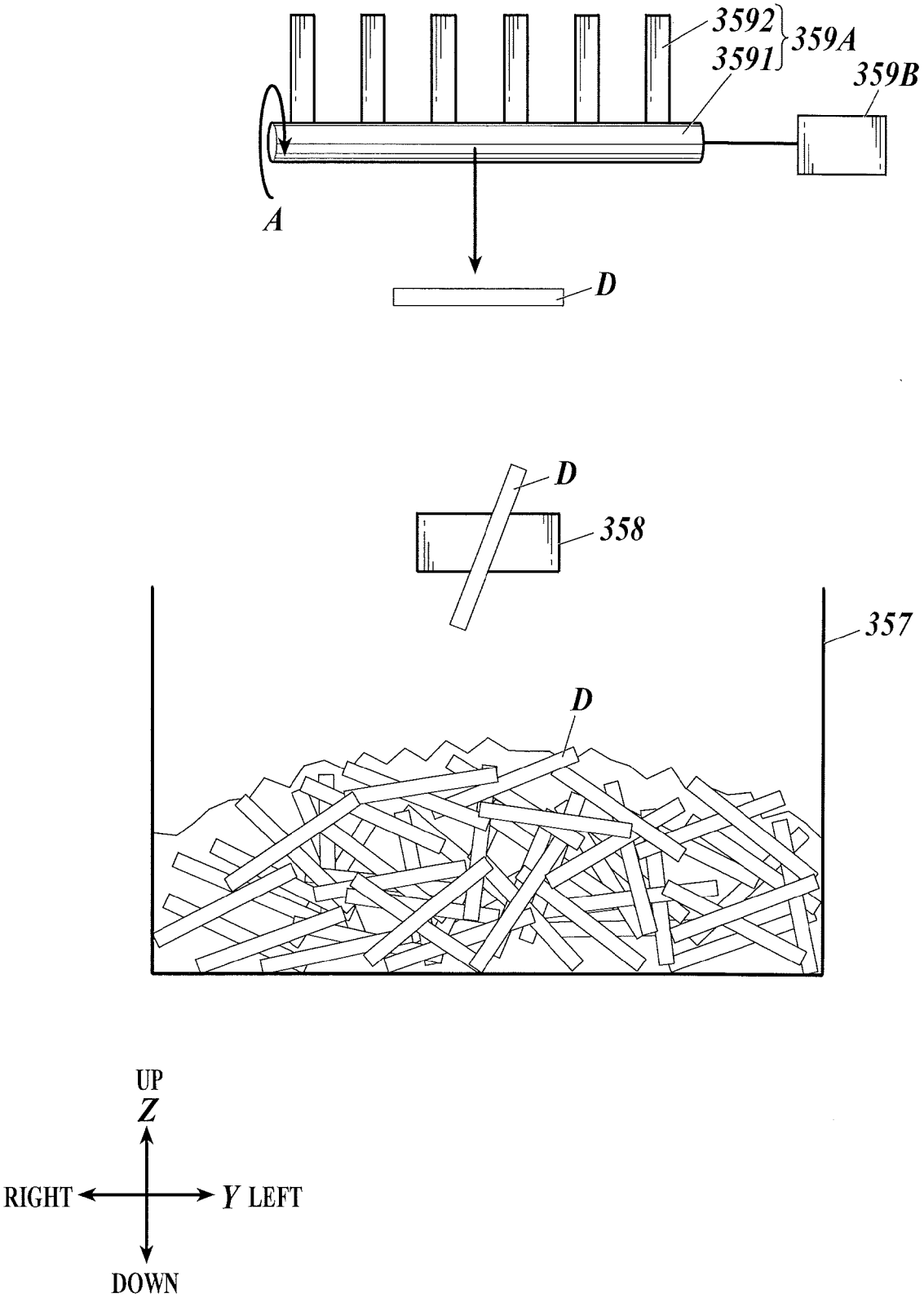
FIG. 4 is a schematic view illustrating an example of the configuration of a movable part.

FIG. 4 is a schematic view illustrating an example of the movable part 359. FIG. 4 is a view of the movable part 359 from the rear side.

As illustrated in FIG. 4, the movable part 359 includes a rotating member (movable member) 359A that is rotated in the direction of the arrow A to come in contact with the chips D at a predetermined timing, and a drive unit 359B that rotates the rotating member 359A.

The rotating member 359A extends in the width direction of the saddle-stitched booklet (Y direction). Specifically, for example, the rotating member 359A includes a rotating shaft 3591 that extends in the Y direction (width direction of the saddle-stitched booklet) and fins 3592 disposed on the rotating shaft 3591.

The fins 3592 are made of a pilable material such as a plastic material. The fins 3592 are rotated around the rotating shaft 3591 to come in contact with the produced chip D, so as to apply a force to the chip D in the diagonal direction toward the rear down side (horizontal and downward directions) to help the chip D fall down in the downward direction.

It is preferred that the fins 3592 are disposed at the same phase with respect to the rotating shaft 3591. That is, it is preferred that the fins 3592 are aligned in the Y direction. When the rotating member 359A is rotated, this allows the fins 3592 to come in contact with the overall part of the chip D which is long in the Y direction. As a result, the chip D can fall down in a more horizontal state.

In this way, the movable part 359 applies a force to the chip D in the direction toward the rear down side to let the chip D fall down. Therefore, when a chip D sticks to the vicinity of the detector 358, a newly produced chip D is more likely to fall down on the stuck chip D, which helps the stuck chip D fall down.

The drive unit 359B is constituted by, for example, a motor or the like driven by a control of the sheet processing control section 505. When the trimming process starts, the driving unit 395B is driven to rotate the rotating shaft 3591 and thus the rotating member 359A.

Returning to FIG. 1, the ejecting section 360 is above the clamping section 340. The ejecting section 360 includes a loading unit on the upper surface of the sheet processing apparatus 300 and a turnabout unit which receives the saddle-stitched booklet from the clamping section 340 and which ejects the booklet to the loading unit.

After the fore edge trimming section 350 performs The fore edge trimming and the clamping section 340 conveys the saddle-stitched booklet in a vertical state upward, the turnabout unit turns the booklet into an approximately horizontal state. The booklet is then ejected such that booklets are piled up on the loading unit one after another.

The side stitching apparatus 400 performs side stitching, etc. for a plurality of sheets.

Specifically, the side stitching apparatus 400 includes, for example, a stapling section which staples sheets received from the sheet processing apparatus 300, a page end trimming section which trims a part of an end portion of the stapled sheets that are parallel to the spine so as to align the end portion, and an ejecting section which ejects the sheets that have been processed by the connected apparatuses.

The side stitching apparatus 400 can eject the sheets received from the sheet processing apparatus 300 without performing a part or all of the various processes by the side stitching apparatus 400.

Next, the operation control of the image forming system 1 will be described.

Figure 5:
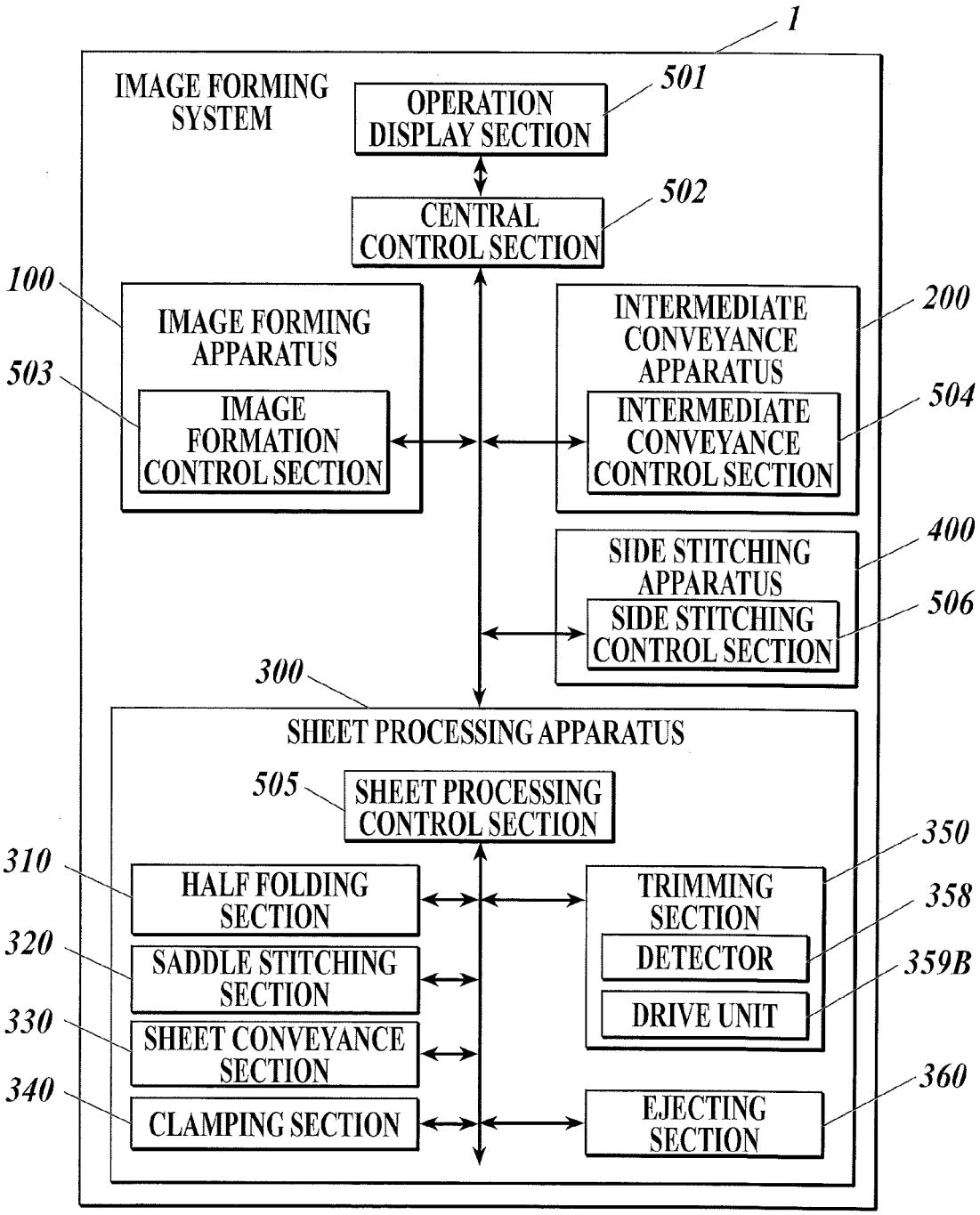
FIG. 5 is a block diagram illustrating the main configuration of the operation control in the image forming system.

FIG. 5 is a block diagram showing the main configuration according to the operation control in the image forming system 1.

The image forming system 1 includes an operation display section 501 which receives input operation from a user in relation to the operation of the image forming system 1 and which displays in accordance with the operation of the image forming system 1, a central control section 502 which controls operations of the entire image forming system 1, an image formation control section 503 which controls operations of the image forming apparatus 100, an intermediate conveyance control section 504 which controls operations of the intermediate conveyance apparatus 200, a sheet processing control section (control section) 505 which controls operations of the sheet processing apparatus 300 and a side stitching control section 506 which controls operations of the side stitching apparatus 400.

The operation display section 501 includes, for example, a touch panel type operation display unit or switches and keys for various types of input to send a signal according to the input from the user to the central control section 502.

Each of the central control section 502, the image formation control section 503, the intermediate conveyance control section 504, the sheet processing control section 505, and the side stitching control section 506 includes a CPU (Central Processing Unit), a RAM (Random Access Memory), a ROM (Read Only Memory) and such like to read out a software program and various types of data according to processing and execute the processing.

In response to the input from the user via the operation display section 501, the central control section 502 sets various types of conditions concerning the image forming system 1.

These conditions include a sheet size, the number of colors to form images (for example, full-color, gray scale, monochrome, etc.), the number of sheets to be half-folded, nip pressure in the half folding processing, the number of sheets in a single booklet to be saddle-stitched, the type, size and weight of sheets to be saddle-stitched, the number of staples to be inserted into the crease of the sheets in saddle stitching, a position where staples are inserted in saddle stitching, whether to trim the fore edge of the saddle-stitched booklet, etc.

Then, the central control section 502 outputs instructions to perform the processing according to the setting to the image formation control section 503, the intermediate conveyance control section 504, the sheet processing control section 505 and the side stitching control section 506. The control sections control operations of the respective apparatuses to be controlled according to the instructions.

For example, the central control section 502 outputs an instruction for performing half folding, saddle stitching, trimming, etc. to the saddle stitching control section 505.

In response to this, the sheet processing control section 505 controls the sections to perform processing.

For example, the sheet processing control section 505 controls the fore edge trimming section 350 to perform the trimming.

Further, the sheet processing control section 505 performs height determination which is to make a determination as to whether the top of the piled chips D that are produced by the trimming and collected in the container 357 has reached the predetermined height.

Specifically, when the detector 358 detects a chip D (i.e. the detector 358 becomes "ON"), the sheet processing control section 505 performs the trimming of the next saddle-stitched booklet. Then, when the detector 358 is still "ON" after the trimming of the next booklet, the sheet processing control section 505 determines that the top of the piled chips D in the container 357 has reached the predetermined height.

Hereinafter, the above-described height determination performed during the trimming process will be described with the flowchart of FIG. 6. Before the process, the clamping members 341, 342 of the clamping section 340 hold the saddle-stitched booklet and take it down toward the gap between the trim and clamp members 352, 353.

First, in Step S1, the sheet processing control section 505 drives the drive unit 359B to start rotation of the rotating shaft 3591 and the rotating member 359A.

Next, in Step S2, after the saddle-stitched booklet is taken down to a predetermined position, the sheet processing control section 505 clamps the saddle-stitched booklet by the trim and clamp members 352, 353 and moves the trimming knife 354 to trim the fore edge of the saddle-stitched booklet.

As a result, chips D are produced, and the produced chips D fall in the downward direction.

Next, in Step S3, the sheet processing control section 505 makes a determination as to whether the detector 358 is "ON".

In view of the fall time of the chips D, the determination in Step S3 is made after a predetermined time has elapsed since the fore edge of the saddle-stitched booklet is trimmed in Step S2.

If the detector 358 is not "ON" (Step S3: NO), in the following Step S4, the sheet processing control section 505 makes a determination as to whether there is another booklet to be processed. If there is another booklet to be processed (Step S4: YES), the process continues to Step S2. If there is no booklet to be processed (Step S4: NO), the process ends.

If the detector 358 is "ON" (Step S3: YES), in the following Step S5, the sheet processing control section 505 makes a determination as to whether there is another booklet to be processed. If there is no booklet to be processed (Step S5: NO), the process ends.

If there is another booklet to be processed (Step S5: YES), in the following Step S6, the sheet processing control section 505 clamps the saddle-stitched booklet by the trim and clamp members 352, 353 and moves the trimming knife 354 to trim the fore edge of the saddle-stitched booklet.

Next, in Step S7, the sheet processing control section 505 makes a determination as to whether the detector 358 is "ON".

As with the determination in the above-described Step S3, the determination in Step S7 is made after a predetermined time in view of the fall time of the chips D has elapsed since the fore edge of the saddle-stitched booklet is trimmed in Step S6.

If the detector 358 is not "ON" (Step S7: NO), the Sheet processing control section 505 continues the process to the above-described Step S4.

If the detector 358 is "ON" (Step S7: YES), in the following Step S8, the sheet processing control section 505 determines that the top of the piled chips D has reached the predetermined height.

Next, in Step S9, the sheet processing control section 505 displays a message on the operation display section 501 so as to notify the user that the top of the piled chips D has reached the predetermined height, i.e. a predetermined amount of chips D has been collected.

Alternatively, the notification may be made by, for example, making a predetermined sound, turning on a lamp or the like.

Next, in Step S10, the sheet processing control section 505 stops the operation of the fore edge trimming section 350, and the process ends.

In Step S10, the operation of the fore edge trimming section 350 may be stopped either immediately or a predetermined time after it is determined in Step S8 that the top of the piled chips D has reached the predetermined height.

Figure 7:
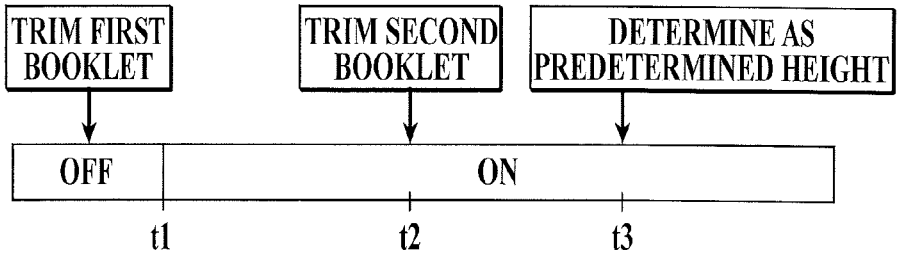
FIG. 7 illustrates a detecting state of a detector in the height determination according to the first embodiment.

FIG. 7 illustrates a detecting state of the detector 358 in the height determination according to this embodiment.

Figure 6:
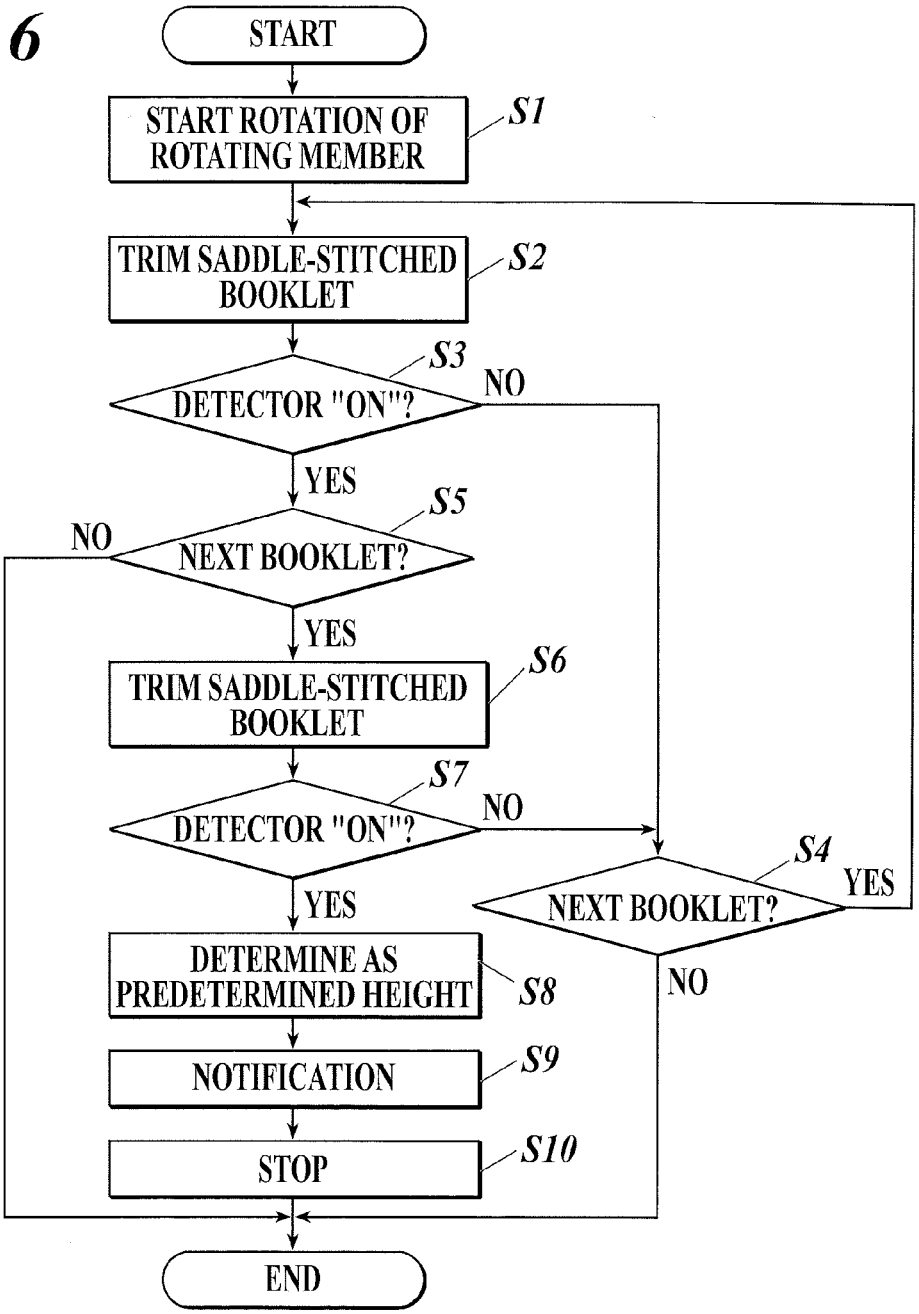
FIG. 6 is a flowchart of height determination performed in a trimming process according to a first embodiment.

As illustrated in FIG. 7, in the height determination according to this embodiment, when the detector 358 becomes "ON" (t1, Step S3 in FIG. 6: YES), the sheet processing control section 505 trims the next booklet (t2, Step S6 in FIG. 6). Then, when the detector 358 is still "ON" after the trimming (Step S7 in FIG. 6: YES), the sheet processing control section 505 determines that the top of the piled chips D has reached the predetermined height (t3, Step S8 in FIG. 6).

In this process, even when the detector 358 becomes "ON" due to a chip D that wrongly sticks to the vicinity of the detector 358 in the middle of the falling pathway, chips D produced by trimming the next booklet can collide with the stuck chip D to let it fall down. Then, the state of the detector 358 changes to an undetected state.

Since the movable part 359 applies a force to produced chips D, the newly produced chips D are more likely to fall down on the stuck chip D.

In this embodiment, the trimming section trims a sheet set (saddle-stitched booklet), but it can also trim a single sheet.

As described above, this embodiment includes: the trimming section (the trim and clamp members 352, 353 and the trimming knife 354) that performs the trimming to trim the fore edge (a part) of a sheet or sheet set (saddle-stitched booklet); the container 357 that is disposed below the trimming section to collect the chip D produced by the trimming in the trimming section; the detector 358 that detects the presence of the chip D at the predetermined height; and the sheet processing control section 505 that makes the trimming section perform the trimming of the next saddle-stitched booklet when the detector 358 detects the chip D and then determines that the top of the piled chips D in the collector 357 has reached the predetermined height when the detector 358 still detects the presence of the chip D after the trimming of the next saddle-stitched booklet.

Accordingly, even when a chip D wrongly sticks to the vicinity of the detector 358 during the trimming, a determination as to whether the top of the piled chips D has reached the predetermined height is made after a chip D produced by the next trimming collides with the stuck chip D to let it fall down. This can prevent false detection by the detector 358, and it can be therefore correctly detected that the top of the piled chips D has reached the predetermined height.

This embodiment includes the movable part 359 that is disposed above the detector 358 and that comes in contact with the chips D produced by the trimming in the trimming section to apply a force in the horizontal and downward directions.

Therefore, the chips D produced by the trimming fall down from the trimming section such that they are more likely to collide with the chip D stuck in the vicinity of the detector 358, which helps the stuck chip D fall down.

In this embodiment, the movable part 359 includes a movable member that extends in the width direction of the saddle-stitched booklet (Y direction). Specifically, the movable member includes the rotating shaft 3591 that extends in the width direction of the saddle-stitched booklet (Y direction) and the fins 3592 that are disposed on the rotating shaft at the same phase.

When the movable member is driven, it comes in contact with the overall part of a chip D that is long in the Y direction so that the chip D can fall down in a more horizontal state. Therefore, the chip D is more likely to collide with the chip D stuck in the vicinity of the detector 358, which helps the stuck chip D fall down.

Second Embodiment

Next, a second embodiment of the present invention will be described mainly in the features that are different from the first embodiment.

In the second embodiment, when a detector 358 detects the presence of a chip D, a sheet processing control section 505 makes a trimming section perform trimming of the next plurality of sheets or sheet sets (saddle-stitched booklets). Then, when the detector 358 still detects the presence of a chip D after the trimming of the next plurality of sheets or sheet sets, the sheet processing control section 505 determines that the top of the piled chips D in a container 357 has reached a predetermined height.

The second embodiment may further include an estimating section that estimates the amount of free space of the container 357. The estimating section is constituted by, for example, a counter that counts the number of times of successively performed trimming or a scale that measures the weight of the container 357, and the amount of free space of the container 357 may be estimated from the value counted or measured by the estimating section 357. However, the method of estimating the amount of free space of the container 357 is not limited to these examples.

In this case, the sheet processing control section 505 may be configured such that the number of times of trimming that the fore edge trimming section 350 performs to the next sheets or sheet sets is selected according to the amount of free space of the container 357.

For example, when the amount of free space of the container 357 is 50%, the sheet processing control section 505 performs the trimming for five times. When the amount of free space of the container 357 is 10%, it performs the trimming for two times.

Alternatively, the sheet processing control section 505 may be configured to perform a predetermined calculation or the like in order to estimate the amount of free space of the container 357. In this case, the sheet processing control section 505 serves as the estimating section.

Hereinafter, height determination performed during the trimming process according to the second embodiment will be described with the flowchart of FIG. 8. The same reference signs are denoted to the same steps as those in FIG. 6, and the description thereof is omitted.

When the detector 358 is "ON" in Step S7 (Step S7: YES), in the following Step S11, the sheet processing control section 505 makes a determination as to whether the trimming has been performed to a predetermined plural number of saddle-stitched booklets. If the number of trimmed saddle-stitched booklets is less than the predetermined number (Step S11: NO), the process returns to Step S5 to repeat the following steps. If the number of trimmed saddle-stitched booklets has reached the predetermined number (Step S11: YES), the process continues to Step S8.

Figure 9A:
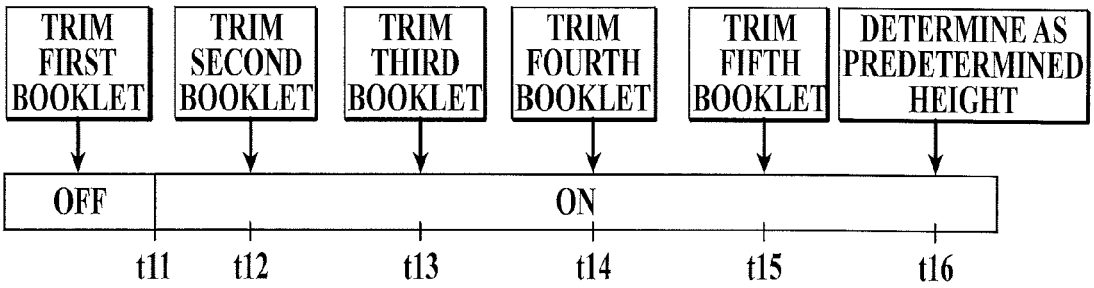
FIG. 9A illustrates a detecting state of a detector in the height determination according to the second embodiment.
Figure 9B:
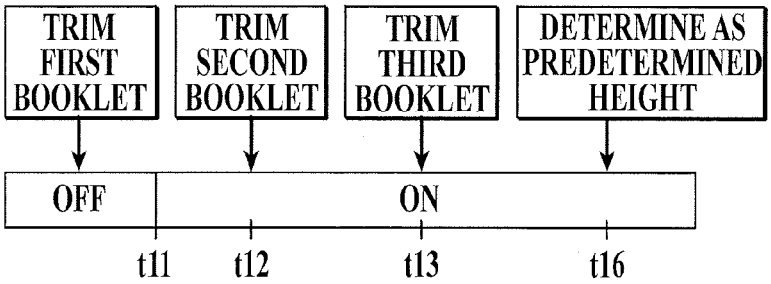
FIG. 9B illustrates a detecting state of a detector in the height determination according to the second embodiment.

FIG. 9A and FIG. 9B illustrate a detecting state of the detector 358 in the height determination according to this embodiment, where FIG. 9A illustrates a case in which the estimating section estimates the amount of free space of the container 357 as 50%, and FIG. 9B illustrates a case in which the estimating section estimates the amount of free space of the container 357 as 10%.

Figure 8:
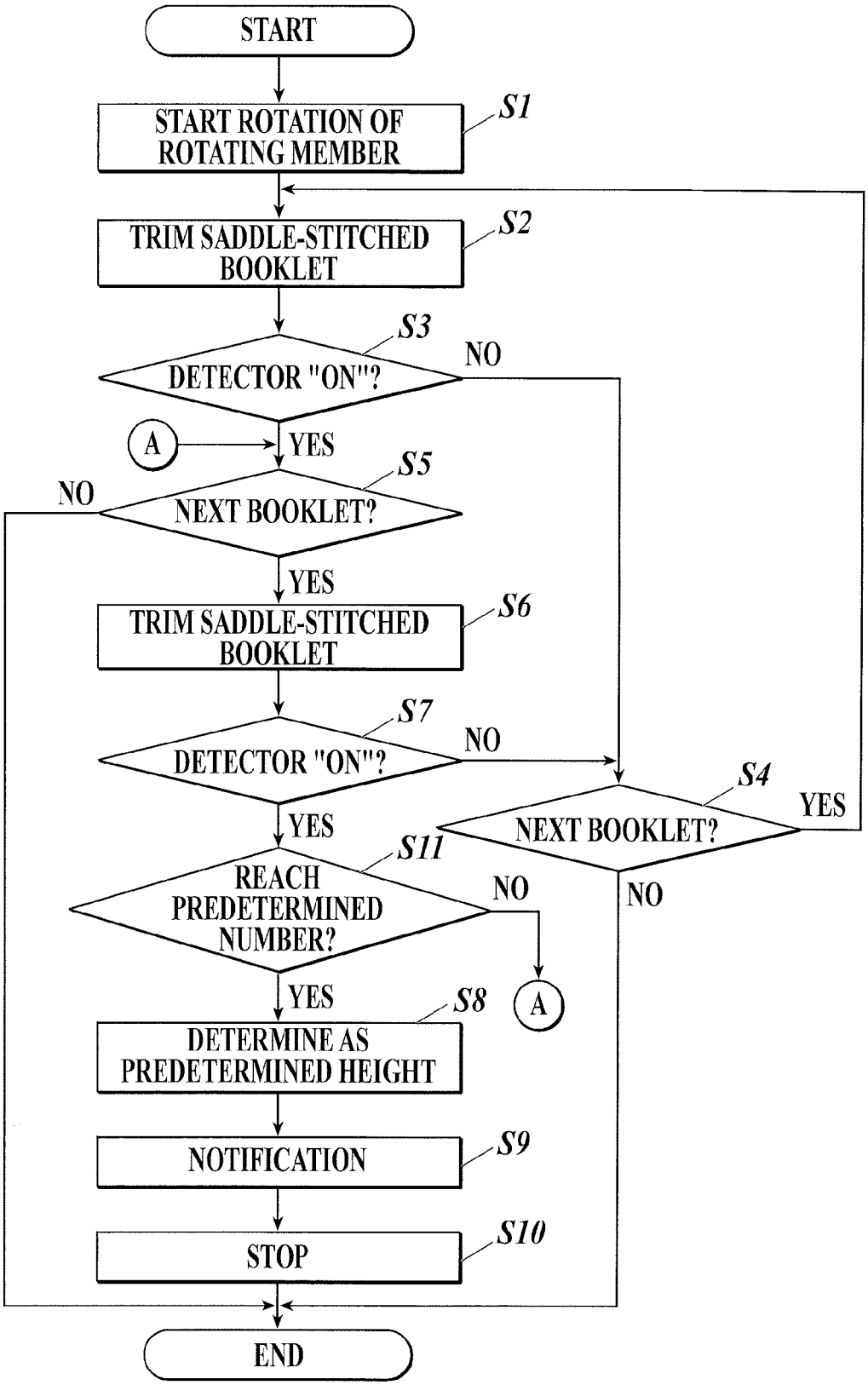
FIG. 8 is a flowchart of height determination performed in a trimming process according to a second embodiment.

As illustrated in FIG. 9A, when the amount of free space of the container 357 is 50%, the next four booklets are trimmed (t12 to t15, Step S6 in FIG. 8) after the detector 358 becomes "ON" (t11, Step S3 in FIG. 8: YES). Then, when the detector 358 is still "ON" after the four booklets are trimmed (Step S11 in FIG. 8: YES), it is determined that the top of the piled chips D has reached a predetermined height (t16, Step S8 in FIG. 8).

As illustrated in FIG. 9B, when the amount of free space of the container 357 is 10%, the next two booklets are trimmed (t12 and t13, Step S6 in FIG. 8) after the detector 358 becomes "ON" (t11, Step S3 in FIG. 8: YES). When the detector 358 is still "ON" after the two booklets are trimmed (Step S11 in FIG. 8: YES), it is determined that the top of the piled chips D has reached the predetermined height (t16, Step S8 in FIG. 8).

In this way, in this embodiment, when the detector 358 detects the presence of a chip D, the sheet processing control section 505 makes the trimming section perform the trimming of the next plurality of sheets or sheet sets (saddle-stitched booklets). Then, when the detector 358 still detects the presence of the chip D after the trimming of the next plurality of sheets or sheet sets, the sheet processing control section 505 determines that the top of the piled chips D in the container 357 has reached the predetermined height.

Accordingly, even when a chip D sticks to the vicinity of the detector 358 during the trimming, a determination as to whether the top of the piled chips D has reached the predetermined height is made after the chips D produced by the next plural times of trimming collide with the stuck chip D to let it fall down. Therefore, false detection by the detector 358 can be prevented more certainly.

This embodiment includes the estimating section that estimates the amount of free space of the container 357, and the sheet processing control section 505 selects the number of times of trimming that the trimming section performs to the next saddle-stitched booklet according to the amount of free space of the container 357.

Accordingly, the number of times of trimming can be suitably selected according to the amount of free space of the container 357. Therefore, false detection by the detector 358 can be prevented more certainly, and it can also be prevented that the top of the piled chips D goes beyond the predetermined height.

Third Embodiment

Next, a third embodiment of the present invention will be described mainly in the features that are different from the first embodiment.

In the third embodiment, when a detector 358 detects a chip D, the sheet processing control section 505 makes a trimming section perform trimming of the next sheet or sheet set (saddle-stitched booklet). Then, when the detector 358 still detects the presence of the chip D after a predetermined time has elapsed since the trimming of the next saddle-stitched booklet, the sheet processing control section 505 determines that the top of the piled chips D in the container 357 has reached the predetermined height.

Hereinafter, height determination performed during the trimming process according to the third embodiment will be described with the flowchart of FIG. 10. The same reference signs are denoted to the same steps as those in FIG. 6, and the description thereof is omitted.

After the fore edge of a saddle-stitched booklet is trimmed in Step S6, in the following step S21, the sheet processing control section 505 makes a determination as to whether the predetermined time has elapsed. If the predetermined time has not elapsed yet (Step S21: NO), Step S21 is repeated. If the predetermined time has elapsed (Step S21: YES), the sheet processing control section 505 continue the process to Step S7.

Figure 11:
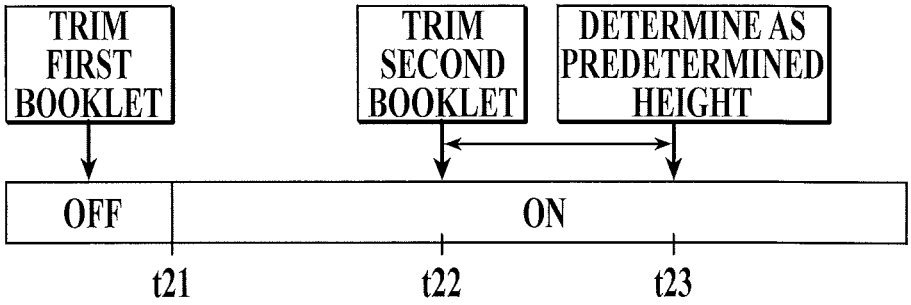
FIG. 11 illustrates a detecting state of a detector in the height determination according to the third embodiment.

FIG. 11 illustrates a detecting state of the detector 358 in the height determination according to this embodiment.

Figure 10:
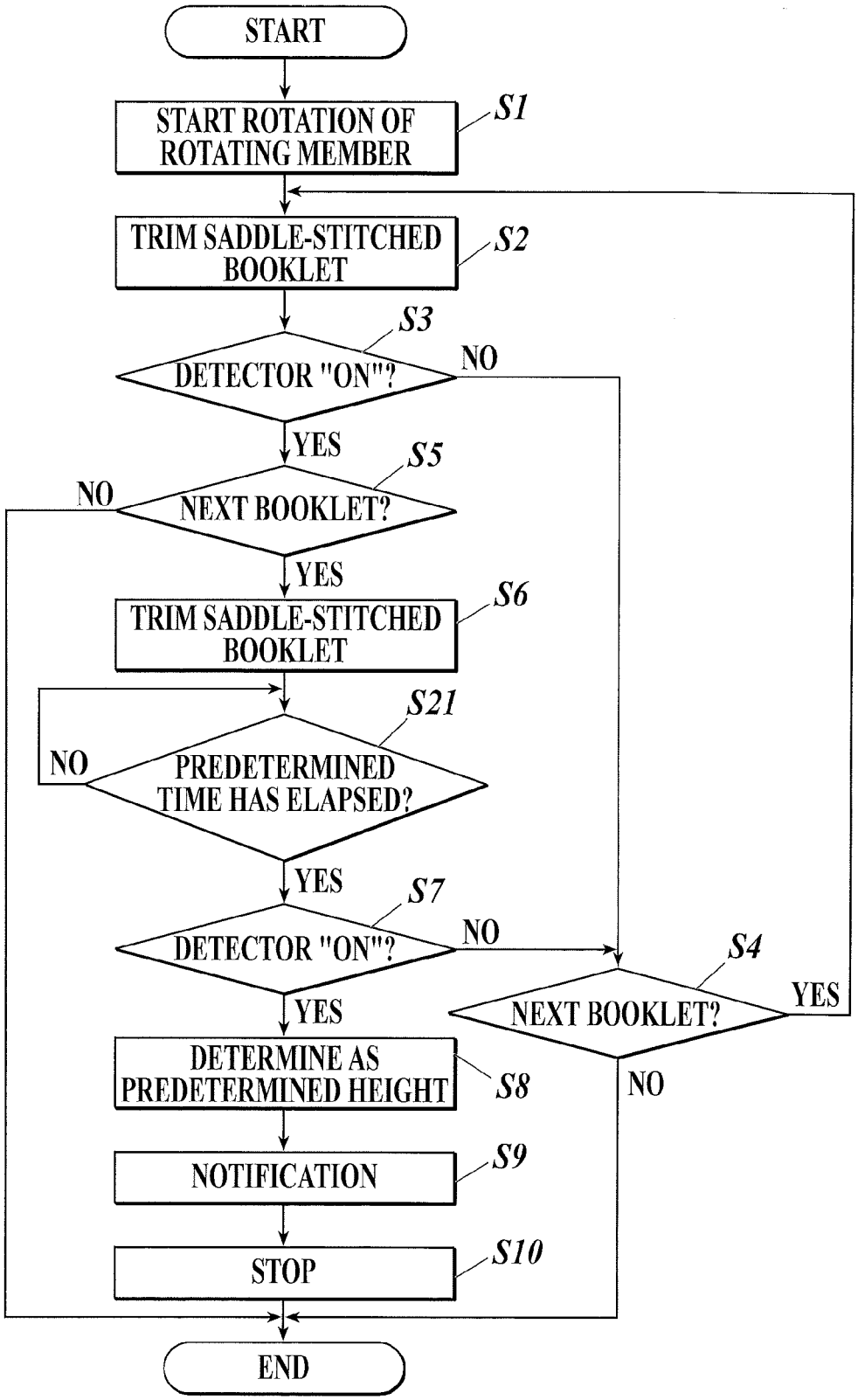
FIG. 10 is a flowchart of height determination performed in a trimming process according to a third embodiment.

As illustrated in FIG. 11, when the detector 358 becomes "ON" (t21, Step S3 in FIG. 10), the next booklet is trimmed (t22, Step S6 in FIG. 10). Then, when the detector 358 is still "ON" (Step S7 in FIG. 10: YES) after the predetermined time has elapsed (Step S21 in FIG. 10: YES), it is determined that the top of the piled chips D has reached a predetermined height (t23, Step S8 in FIG. 10).

In this way, in this embodiment, when the detector 358 detects a chip D, the sheet processing control section 505 makes the trimming section perform the trimming of the next sheet or sheet set (saddle-stitched booklet). Then, when the detector 358 still detects the chip D after the predetermined time has elapsed since the trimming of the next sheet or sheet set, the sheet processing control section 505 determines that the top of the piled chips D in the container 357 has reached the predetermined height.

Accordingly, even when a chip D sticks to the vicinity of the detector 358 during the trimming, a determination as to whether the top of the piled chips D has reached the predetermined height is made after the chip D produced by the next trimming collides with the stuck chip D to let it fall down and a certain time has further elapsed while the stuck chip D falls down due to release of the static electricity, vibration of the apparatus or the like. Therefore, false detection by the detector 358 can be prevented more certainly.

The above-described embodiments are examples in Which the rotating member 359A with the fins 3592 is provided as the movable part 359. However, the movable part 359 may be constituted by any member that is long in the width direction of the sheet. For example, a single plate that is long in the width direction of the sheet may be provided instead of the fins 3592.

The above-described embodiments are examples in which the movable part 359 is configured such that the rotating member 359A rotates. Instead of rotation, for example, a knife may move linearly in the horizontal or downward direction so as to come in contact with a chip D.

The above-described embodiments are examples in which the fore edge of a saddle-stitched booklet is trimmed. However, the determination process of the collected amount in these embodiments is also applicable to other trimming that produces chips (e.g. punching).

The entire disclosure of Japanese Patent Application No. 2014-240923 filed on Nov. 28, 2014 including description, claims, drawings, and abstract are incorporated herein by reference in its entirety.

What is claimed is:

1. A sheet processing apparatus, comprising:

a trimming section which performs trimming to trim a sheet or sheet set;

a container which collects a chip produced by the trimming in the trimming section;

a detector which detects a presence of the chip at a predetermined height; and a control section which controls the trimming section, wherein the control section makes the trimming section perform the trimming of a next sheet or sheet set when the detector detects the chip and then determines that a top of piled chips in the container has reached the predetermined height when the detector still detects the presence of the chip after the trimming of the next sheet or sheet set.

2. The sheet processing apparatus according to claim 1, further comprising:

a movable part which is disposed above the detector and which comes in contact with the chip produced by the trimming in the trimming section to apply a force in at least one of horizontal and downward directions.

3. The sheet processing apparatus according to claim 2, wherein the movable part comprises a movable member that extends in a width direction of the sheet.

4. The sheet processing apparatus according to claim 3, wherein the movable member comprises a rotating shaft which extends in the width direction of the sheet and fins which are disposed on the rotating shaft.

5. The sheet processing apparatus according to claim 1, wherein the control section makes the trimming section perform the trimming of a next plurality of sheets or sheet sets when the detector detects the chip and which then determines that the top of the piled chips in the container has reached the predetermined height when the detector still detects the presence of the chip after the trimming of the next plurality of sheets or sheet sets.

6. The sheet processing apparatus according to claim 5, further comprising:

an estimating section which estimates the amount of free space of the container, wherein the control section selects the number of times of the trimming that the trimming section performs to the next plurality of sheets or sheet sets according to the amount of free space of the container estimated by the estimating section.

7. The sheet processing apparatus according to claim 1, wherein the control section makes the trimming section perform the trimming of the next sheet or sheet set when the detector detects the chip and which then determines that the top of the piled chips in the container has reached the predetermined height when the detector still detects the presence of the chip after a predetermined time has elapsed since the trimming of the next sheet or sheet set.

8. An image forming system, comprising:

an image forming apparatus which forms an image on a sheet or sheet set; and the sheet processing apparatus according to claim 1 which is connected with the image forming apparatus and which performs trimming of the sheet or sheet set on which the image is formed by the image forming apparatus.

* * * * *